US008074845B2

(12) United States Patent
Garcia et al.

(10) Patent No.: US 8,074,845 B2
(45) Date of Patent: Dec. 13, 2011

(54) FLUID PRODUCT DISPENSING ELEMENT AND DISPENSER COMPRISING ONE SUCH ELEMENT

(75) Inventors: Firmin Garcia, Evreux (FR); Stéphane Beranger, Le Neubourg (FR)

(73) Assignee: Valois S.A.S., Le Neubourg (FR)

( * ) Notice: Subject to any disclaimer, the term of this patent is extended or adjusted under 35 U.S.C. 154(b) by 2019 days.

(21) Appl. No.: 10/525,224

(22) PCT Filed: Dec. 19, 2003

(86) PCT No.: PCT/FR03/03835

§ 371 (c)(1),
(2), (4) Date: Feb. 22, 2005

(87) PCT Pub. No.: WO2004/058413

PCT Pub. Date: Jul. 15, 2004

(65) Prior Publication Data

US 2006/0037973 A1 Feb. 23, 2006

(30) Foreign Application Priority Data

Dec. 23, 2002 (FR) ..... 02 16547
Jul. 10, 2003 (FR) ..... 03 08493

(51) Int. Cl.
*B65D 88/54* (2006.01)

(52) U.S. Cl. ..... 222/321.9; 215/274

(58) Field of Classification Search .... 222/321.1–321.9, 222/384, 385, 320; 215/273, 274
See application file for complete search history.

(56) References Cited

U.S. PATENT DOCUMENTS

| | | | | |
|---|---|---|---|---|
| 4,252,507 | A * | 2/1981 | Knickerbocker | 417/444 |
| 5,299,703 | A * | 4/1994 | Cater | 215/274 |
| 6,170,713 | B1 * | 1/2001 | Schultz | 222/321.2 |
| 6,332,561 | B1 * | 12/2001 | Garcia et al. | 222/321.3 |
| 6,360,919 | B1 * | 3/2002 | Brule | 222/189.09 |
| 6,398,079 | B1 * | 6/2002 | Garcia et al. | 222/190 |
| 6,799,690 | B2 * | 10/2004 | de Pous et al. | 215/274 |
| 2002/0066751 | A1 | 6/2002 | Meshberg | |

FOREIGN PATENT DOCUMENTS

| | | |
|---|---|---|
| EP | 0-390-717 A2 | 10/1990 |
| FR | 2-678-906 A1 | 1/1993 |
| FR | 2-704-524 A1 | 11/1994 |

* cited by examiner

*Primary Examiner* — Lien Ngo
(74) *Attorney, Agent, or Firm* — Sughrue Mion, PLLC

(57) ABSTRACT

A fluid dispenser member for mounting on an opening (90) of a fluid reservoir (9), said member comprising: a body (1) inwardly defining a chamber (15) of variable volume, said body defining a bottom end (10); an actuator rod (7) that can be reciprocated axially in said body, and comprising a top portion defining a top end (79); a peripheral bearing collar (52) extending radially outwards, and including a bottom face (51) designed to come into abutment, at least indirectly, against an edge (911) of the opening (90) of the fluid reservoir; and a neck gasket (2) disposed in contact with the bottom face (51) of the collar so as to be compressed between the collar (52) and the edge (911) of the opening, the axial height HS1 axially separating the bottom face of the collar from the top end of the actuator rod being substantially equal to the axial height HI1 axially separating the bottom face of the collar from the bottom end of the body.

19 Claims, 3 Drawing Sheets

FLUID PRODUCT DISPENSING ELEMENT AND DISPENSER COMPRISING ONE SUCH ELEMENT

The present invention relates to a fluid dispenser member for mounting on an opening of a fluid reservoir. The invention also relates to a fluid dispenser comprising a dispenser member and a fluid reservoir. Such dispensers fitted with such members are used, in particular, in the fields of perfumery, cosmetics, or even pharmacy. They are designed for dispensing fluid or powder in the form of a sprayed jet, a continuous stream, or even large droplets.

In general, such dispenser members comprise: a body inwardly defining a chamber of variable volume, said body defining a bottom end; an actuator rod that can be reciprocated axially in said body, thereby causing the volume in said chamber to vary, said rod comprising a bottom portion engaged in the body, and a top portion defining a top end; a peripheral bearing collar extending radially outwards, said collar including a bottom face designed to come into abutment, at least indirectly, against an edge of the opening of the fluid reservoir; and optionally, a neck gasket disposed in contact with the bottom face of the collar so as to be compressed between the collar and the edge of the opening. The neck gasket is only a few tenths of a millimeter thick so that the peripheral bearing collar determines the height of the dispenser member inserted into the opening of the reservoir, and the height of the dispenser member which projects out from the opening of the reservoir. For reasons of appearance, but also for functional reasons, it is advantageous that the height of the dispenser member above the bearing collar is not too high. As a result, most dispenser members include a relatively elongate body which is engaged almost entirely inside the opening of the reservoir. When the opening is defined by a relatively elongate neck, it is possible that the dispenser member does not project below the neck into the body of the reservoir. However, when the neck is very short, as is the case for standard reservoirs, the dispenser member, and more particularly its body, penetrates into the body of the reservoir so that it is possible to see the dispenser member body inside the body of the reservoir when said reservoir is transparent. This presents an appearance that is not very desirable, in particular in the field of perfumery, in which it is always desirable to mask the dispenser member as much as possible.

In any event, most dispenser members present a height below the collar which is three or even four times greater than their height above the collar.

The object of the present invention is to define a dispenser member that is particularly compact, and that is compatible with practically any height of reservoir neck, while being particularly well balanced.

According to a characteristic of the invention, the axial height HS1 between the bottom face of the collar and the top end of the actuator rod is substantially equal to the axial height HI1 between the bottom face of the collar and the bottom end of the body.

In a variant definition, the axial height HS2 between the bottom face of the gasket and the top end of the actuator rod is substantially equal to the axial height HI2 between the bottom face of the gasket and the bottom end of the body.

Given that the neck gasket is very thin, this amounts to the collar being disposed substantially half way up the dispenser member.

Advantageously, HS1, HS2, HI1, and HI2 are all about 7 millimeters (mm) to 9 mm. The total height of the dispenser member is therefore about 14 mm to 18 mm, and preferably 16 mm to 17 mm, which is particularly short in the fields of cosmetics, perfumery, or pharmacy. The dispenser member is thus practically invisible inside a neck of average or even short height. The bottom end of the body does not even project below the neck into the body of the reservoir.

In the invention, according to another of its aspects, the dispenser member further comprises a dispenser head mounted on the top portion of the rod and forming a dispenser orifice, said head defining a top end, the axial height HS3 between the bottom face of the collar and the top end of the head is slightly greater than the axial height HI2 between the bottom face of the collar and the bottom end of the body. The dispenser head is considered as an accessory to the dispenser member, given that it is possible to mount a plurality of different dispenser heads in any one dispenser member. In the invention, HS3 is about 9 mm to 10 mm. Thus for a gasket presenting a thickness of about 0.5 mm to 1 mm, the axial height HT excluding the head is about 16 mm to 17 mm, and the total axial height with the dispenser head can be about 17 mm to 19 mm.

In the invention, according to yet another of its aspects, the dispenser member can further comprise: a covering hoop designed to extend around the body outside the edge of the opening, said hoop including a top end; and a dispenser head mounted on the top portion of the rod and defining a lateral dispensing orifice, the head being axially displaceable inside the top end of the hoop. In this case, the hoop can be mounted on a fixing ring that is engaged with the body and with the reservoir. The covering hoop usually extends over the entire height of the neck, on the outside thereof, so that the below-collar height of the dispenser member that is inserted into the body of the reservoir is not even visible, since it does not even project below the neck.

The invention also provides a fluid dispenser comprising both a fluid reservoir defining a reservoir with an opening, and a dispenser member as defined above mounted on the opening of the reservoir. The reservoir advantageously includes a substantially cylindrical projecting neck defining the opening, said neck defining a free top end forming an annular edge on which the collar or the gasket rests, and a bottom end connected to the reservoir body, the bottom end of the body being situated in the neck so that it does not extend into the reservoir body. Preferably, the axial height HC of the neck is about 7 mm to 9 mm for an inside diameter of about 8 mm and an outside diameter of about 13 mm.

The invention is described more fully below with reference to the accompanying drawings which show an embodiment of the invention by way of non-limiting example.

Figure 1:
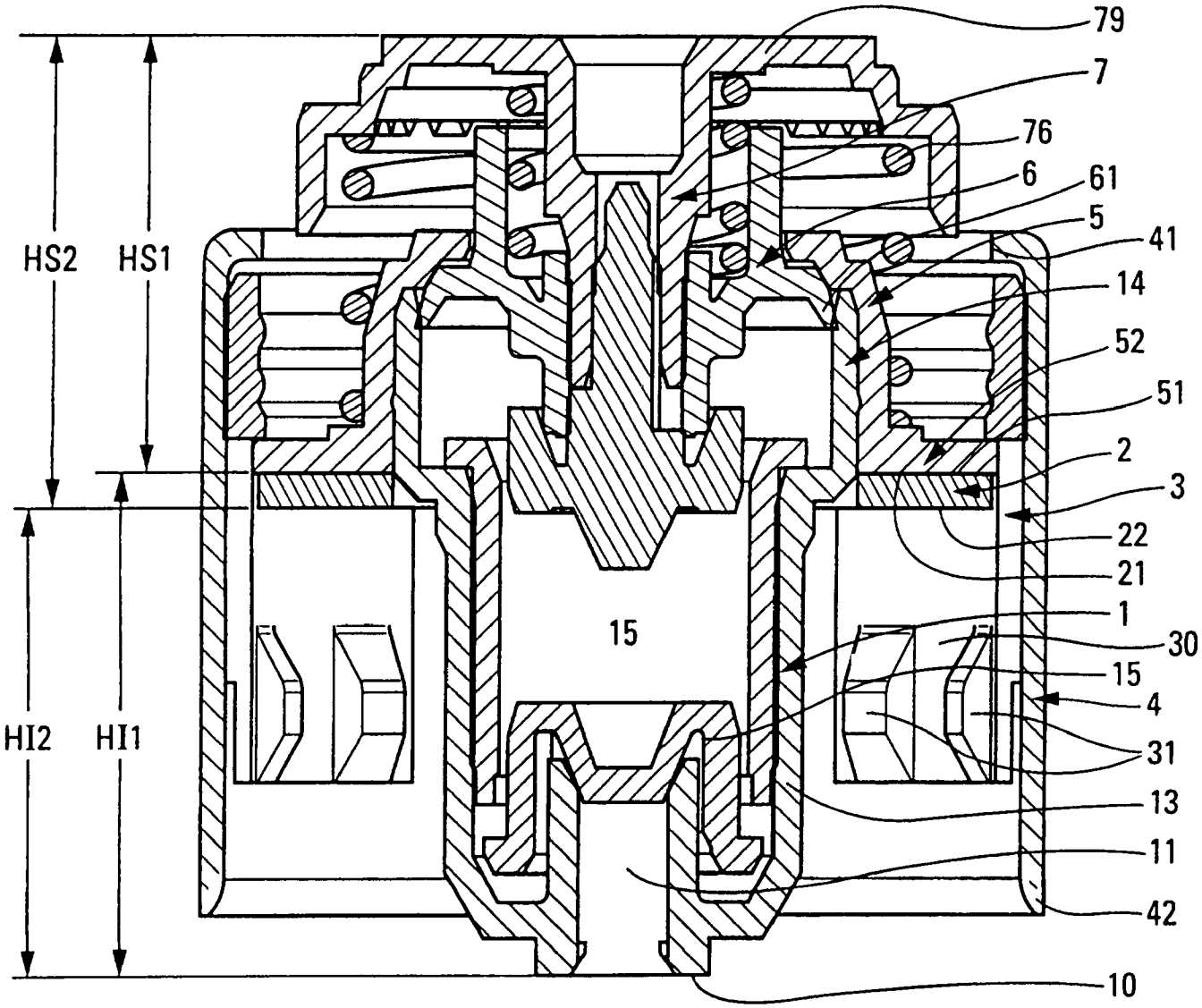
FIG. 1 is a vertical section view through a dispenser member of the invention.

The dispenser member used to illustrate the present invention and shown in the figures is a pump including a pump body 1 of generally cylindrical shape. However, the body 1 is stepped so as to define a bottom section 13 and a top section 14. The top section 14 has a diameter that is greater than the diameter of the bottom section 13. The bottom end of the bottom section 13 defines an inlet 11 which puts the outside into communication with the inside of the body 1 at the bottom section 13. The inlet 11 is defined by an inlet sleeve presenting a bottom end 10 which also forms the bottom-most end of the body 1.

The inlet 11 defines a inlet-valve seat associated with an inlet valve 15 which can be axially displaced between a closed position and an open position.

In addition, a free piston 6 presenting an outer sealing lip 61 is engaged to slide in sealed manner inside the top section 14 which thus defines a sealed slide barrel. A pump chamber 15 is thus defined inside the body 1 between the inlet 11 that is selectively closed by the valve 15, and the free piston 6. The volume of the chamber varies as a result of the piston 6 being displaced inside the top section 14.

The free piston is mounted on an actuator rod 7 which penetrates into the top section 14, and also into the bottom section 13. The free piston 6 is slidably mounted on the actuator rod: the piston and the actuator rod together defining an outlet valve which functions by the piston 6 sliding over a section of the actuator rod 7. A precompression spring makes it possible to urge the piston 6 into the closed, rest position. As soon as the pressure increases inside the pump chamber 15, the free piston 6 is displaced along the rod 7, thereby opening the outlet valve. This is a conventional technique for making an outlet valve. The actuator rod 7 defines an inner flow channel through which the fluid pressurized in the pump chamber 15 can escape, by passing through the open outlet valve. The actuator rod 7 also defines a top end 79 which is also in the form of an annular plate. The actuator rod 7 is urged into the rest position by a return spring 76 that is situated outside the pump chamber 15.

Figure 2:
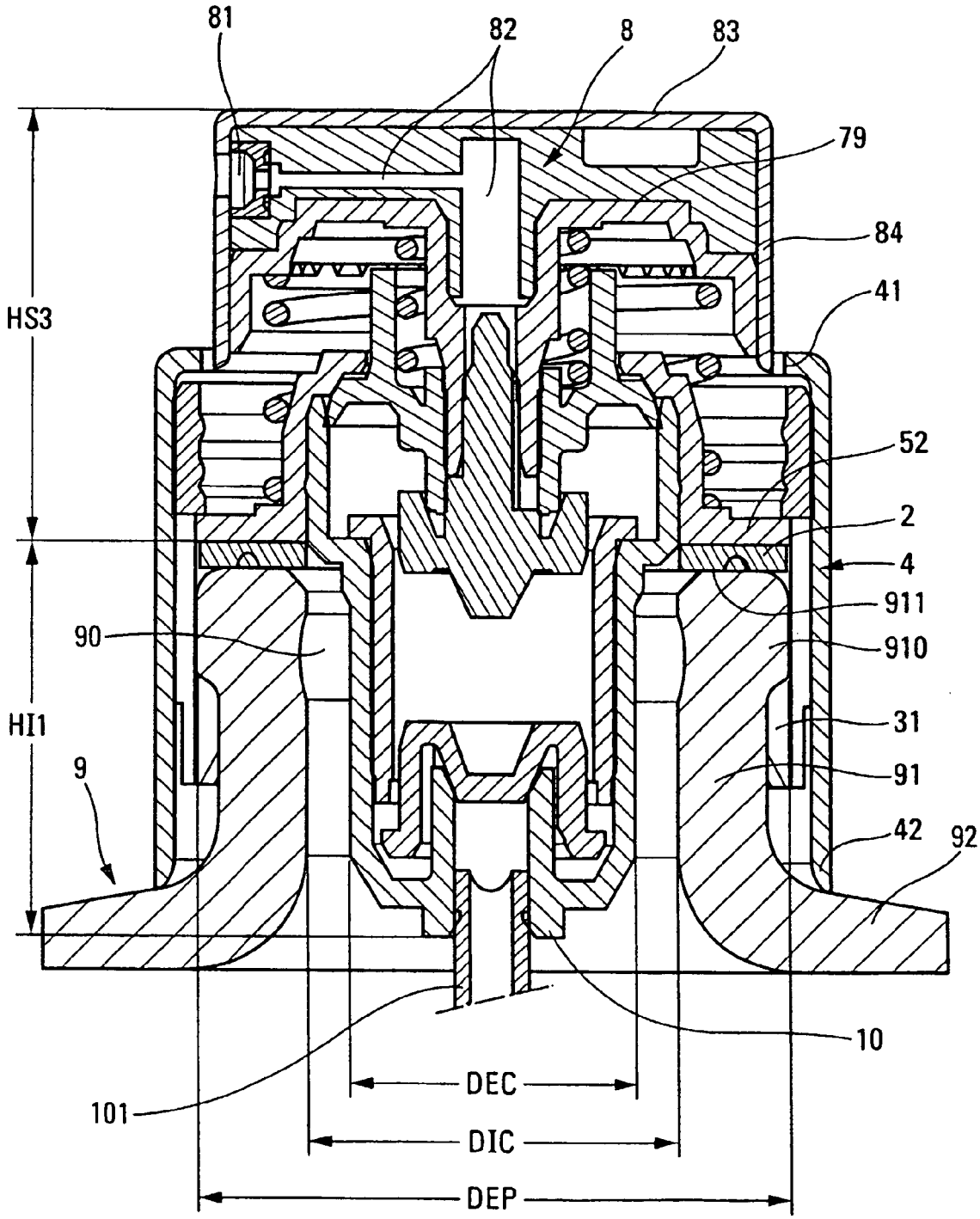
FIG. 2 is a vertical section view through the top portion of a fluid dispenser incorporating a dispenser member of the invention.

The pump also includes a ferrule 5 which defines the top stop point or rest position for the piston 6 and for the actuator rod 7. In other words, the piston 6 comes into abutment against the ferrule 5 when there is no force exerted on the actuator rod 7. The ferrule 5 also forms a bearing collar 52 which extends radially outwards. The bearing collar 52 extends around the body 1 substantially at the junction between the bottom and top sections 13 and 14. The annular bearing collar 52 includes a bottom face 51 in contact with an annular neck gasket 2. The gasket includes a top face 21 in contact with the bottom face 51 of the collar, and a bottom face 22 that faces downwards. The bottom face 22 of the gasket 2 is designed to come into contact with the top end edge 911 of a neck 91 of a reservoir 9. The neck 91 thus defines an opening 90 making it possible to access a reservoir body containing the fluid. The neck 91 can be connected to the body of the reservoir by a shoulder 92 which extends outwards, as can be seen in FIG. 2. The neck 91 can also present an outer peripheral reinforcement 910 which projects radially outwards.

The dispenser member of the invention is conventionally fitted with a dispenser head 8 mounted on the top end of the actuator rod. The dispenser head, which can serve as a pusher, includes a dispenser channel 82 which connects the flow channel formed by the actuator rod to an outlet orifice 81 which can be of the spray-nozzle type. The dispenser head can optionally be provided with a covering cap 83 which extends all around the dispenser head. The covering cap includes both a top press surface 83 which can be pressed by means of a finger, and a cylindrical peripheral skirt 84 which extends downwards from the bearing surface 83.

In addition, the dispenser member includes a fixing ring 3 which enables the dispenser member to be fixed onto the neck 91. In conventional manner, the fixing ring 3 includes reception means for receiving the dispenser member, e.g. via its collar 52, and also includes fixing tabs presenting heads 31 designed to become engaged below the peripheral reinforcement 910 of the neck 91. This constitutes a particular embodiment, but other fixing rings using other techniques could be used. For example, it is possible to envisage a fixing ring that becomes engaged inside the neck 91.

According to another characteristic, the dispenser member includes a covering hoop 4 which comes to cover the fixing ring 3. The covering hoop 4 includes a top end 41 forming an inwardly-directed rim, and a free bottom end 42. The hoop is substantially cylindrical over its entire height. In the invention, the dispenser head 8 can be displaced axially inside the covering hoop 4. Even in the rest position, the bottom end of the skirt 84 is inserted into the top end 41 of the hoop 4. It should also be observed that the covering hoop 4 extends over the height of the neck 9, and its bottom end 42 advantageously comes into abutment against the shoulder 92. Thus, the neck 91 is no longer visible.

Figure 3:
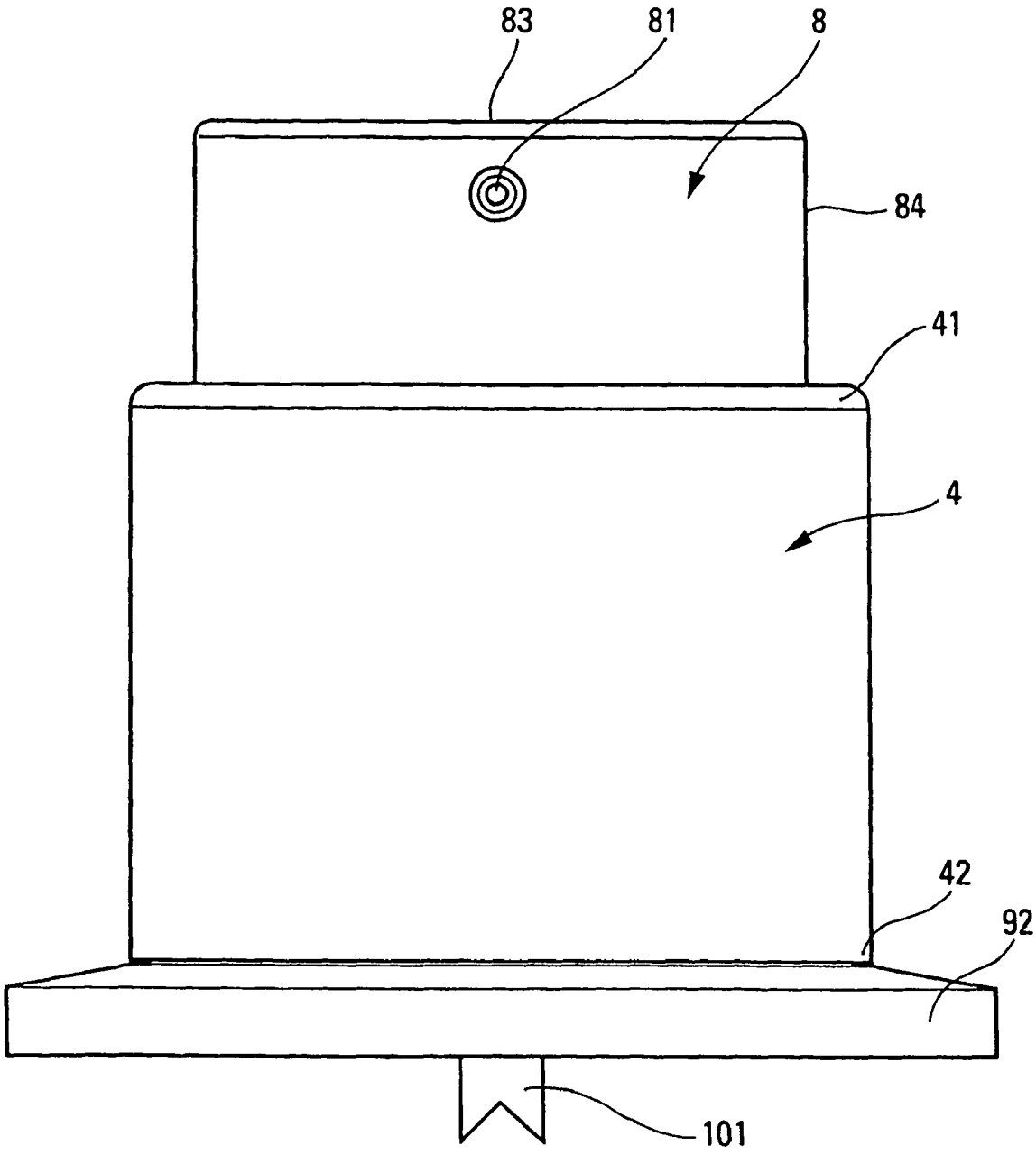
FIG. 3 is a front view of the dispenser top-portion shown in FIG. 2.

According to an advantageous characteristic of the invention, the axial height HS1 defined between the bottom face 51 of the collar 52 and the top end 79 of the actuator rod is substantially equal to the axial height HI1 defined between the bottom face of the collar 51 and the bottom end 10 of the body 1. Given that the neck gasket 2 presents a small thickness of about 0.5 mm to 1 mm, it can also be said that the axial height HS2 defined between the bottom face 22 of the gasket 2 and the top end 79 is substantially equal to the height HI2 defined between the bottom face 22 of the gasket 2 and the bottom end 10 of the body 1. Consequently, the height of the pump which is inserted into the neck 91 is substantially equal to the height of the pump which projects from the neck on omitting the dispenser head 8, which is only an accessory of the pump. Even with the dispenser head 8, it can be said that the axial height HS3 defined between the bottom face 51 of the collar 52 and the top press wall 83 of the dispenser head 8 is substantially equal to, or only slightly greater than, the height HI1 defined between the bottom face of the collar 52 and the bottom face 10 of the body 1. Naturally, a dip tube 101 can be mounted in the inlet 11, as can be seen in FIGS. 2 and 3, but the dip tube 101 does not form part of the pump, constituting only an accessory thereof.

In practice, the axial heights HS1, HS2, HI1, and HI2 can all be about 7 mm to 9 mm. Ideally, HI2 is approximately equal to 8.2 mm, and HI1 is equal to 8.8 mm, the thickness of the gasket being 0.6 mm. This provides a pump that is well balanced and particularly compact, with the bearing collar 52 disposed substantially half way up the pump. In FIGS. 2 and 3, it should also be observed that the bottom end 10 of the pump is situated in the neck without projecting downwards into the reservoir body. Given that the covering hoop 4 extends down to the shoulder 92, the pump is thus completely masked. It can thus be said that it is invisible. This characteristic can be implemented regardless of the fact that the bearing collar is situated substantially half way up the dispenser member.

The dimensions of the neck can be as follows: the outside diameter DEP can be about 13 mm, the inside diameter DIC can be about 8 mm with a neck height of about 7 mm to 9 mm as for HI1 and HI2. The outside diameter of the body at the bottom section 13 can be about 6 mm to 7 mm.

A pump is thus obtained having a total height of 16 mm to 17 mm without the dispenser head, and of 17 mm to 19 mm with the dispenser head.

This pump is particularly compact and very short. Among other things, this is made possible by placing the top section 14 outside the neck. Given that the piston 6 slides inside said section, and that said section can present an inside diameter that is independent of the neck, it is possible to make a pump chamber 15 of suitable volume, while having a stroke that is very short in height.

The invention claimed is:

1. A fluid dispenser comprising both a fluid reservoir defining a reservoir with an opening (90), and a dispenser member mounted on the opening of the reservoir;

the fluid dispenser member comprising:

a body (1) inwardly defining a chamber (15) of variable volume, said body defining a bottom end (10);

an actuator rod (7) that can be reciprocated axially in said body, thereby causing the volume in said chamber to vary, said rod comprising a bottom portion engaged in the body, and a top portion defining a top end (79);

a peripheral bearing collar (52) extending radially outwards, said collar including a bottom face (51) designed to come into abutment, at least indirectly, against an edge (911) of the opening (90) of the fluid reservoir; and wherein the axial height HS1 between the bottom face of the collar and the top end of the actuator rod is substantially equal to the axial height HU between the bottom face of the collar and the bottom end of the body; and wherein HS1 and HI1 are all about 7 mm to 9 mm; and wherein the reservoir (9) includes a substantially cylindrical projecting neck (91) defining the opening (90), said neck defining a free top end forming an annular edge (911) on which the collar (52), and a bottom end connected to the reservoir body, the bottom end (10) of the body being situated in the neck; and wherein the axial height HC of the neck is about 7 mm to 9 mm for an inside diameter of about 8 mm and an outside diameter of about 13 mm.

2. A fluid dispenser comprising both a fluid reservoir defining a reservoir with an opening (90), and a dispenser member mounted on the opening of the reservoir;

the fluid dispenser member comprising:

a body (1) inwardly defining a chamber (15) of variable volume, said body defining a bottom end (10);

an actuator rod (7) that can be reciprocated axially in said body, thereby causing the volume in said chamber to vary, said rod comprising a bottom portion engaged in the body, and a top portion defining a top end (79);

a peripheral bearing collar (52) extending radially outwards, said collar including a bottom face (51); and a neck gasket (2) including a top face (21) and a bottom face (22), the top face (21) being in contact with the bottom face (51) of the collar (52), and the bottom face (22) being designed to come into contact with an edge (911) of the opening (90) of the reservoir (9), wherein the axial height HS2 between the bottom face of the gasket and the top end of the actuator rod is substantially equal to the axial height HI2 between the bottom face of the gasket and the bottom end of the body; and wherein HS2 and HI2 are all about 7 mm to 9 mm; and wherein the reservoir (9) includes a substantially cylindrical projecting neck (91) defining the opening (90), said neck defining a free top end forming an annular edge (911) on which the gasket (2) rests, and a bottom end connected to the reservoir body, the bottom end (10) of the body being situated in the neck; and wherein the axial height HC of the neck is about 7 mm to 9 mm for an inside diameter of about 8 mm and an outside diameter of about 13 mm.

3. A dispenser according to claim 1, further comprising a dispenser head (8) mounted on the top portion of the rod (7) and forming a dispenser orifice (81), said head defining a top end (83), the axial height HS3 between the bottom face of the collar and the top end of the head is slightly greater than the axial height H12 between the bottom face of the collar and the bottom end of the body.

4. A dispenser according to claim 3, in which HS3 is about 9 mm to 10 mm.

5. A dispenser according to claim 1, in which the gasket presents a thickness of about 0.5 mm to 1 mm.

6. A dispenser according to claim 1, presenting an axial height HT of about 16 mm to 17 mm, excluding the head.

7. A dispenser according to claim 1, presenting a total axial height HT of about 17 mm to 19 mm.

8. A dispenser according to claim 1, further comprising:

a covering hoop (4) designed to extend around the body (1) outside the edge of the opening, said hoop including a top end (41); and a dispenser head (8) mounted on the top portion of the rod and defining a lateral dispensing orifice (81), the head being axially displaceable inside the top end of the hoop.

9. A dispenser according to claim 8, in which the hoop is mounted on a fixing ring (3) that is engaged with the body (1) and with the reservoir (9).

10. The dispenser according to claim 1, further comprising a neck gasket disposed in contact with the bottom face of the collar so as to be compressed between the collar and the edge of the opening.

11. The dispenser according to claim 2, further comprising a dispenser head (8) mounted on the top portion of the rod (7) and forming a dispenser orifice (81), said head defining a top end (83), the axial height HS3 between the bottom face of the collar and the top end of the head is slightly greater than the axial height HI2 between the bottom face of the collar and the bottom end of the body.

12. The dispenser according to claim 11, in which HS3 is about 9 mm to 10 mm.

13. The dispenser according to claim 2, in which the gasket presents a thickness of about 0.5 mm to 1 mm.

14. A dispenser according to claim 2, presenting an axial height HT of about 16 mm to 17 mm, excluding the head.

15. The dispenser according to claim 2, presenting a total axial height HT of about 17 mm to 19 mm.

16. The dispenser according to claim 2, further comprising:

a covering hoop (4) designed to extend around the body (1) outside the edge of the opening, said hoop including a top end (41); and a dispenser head (8) mounted on the top portion of the rod and defining a lateral dispensing orifice (81), the head being axially displaceable inside the top end of the hoop.

17. The dispenser according to claim 16, in which the hoop is mounted on a fixing ring (3) that is engaged with the body (1) and with the reservoir (9).

18. The dispenser according to claim 1, further comprising a piston sliding in a top section disposed entirely outside the neck of the reservoir, so that said section can have an inside diameter that is sized independent of the neck.

19. The dispenser according to claim 2, further comprising a piston sliding in a top section disposed entirely outside the neck of the reservoir, so that said section can have an inside diameter that is sized independent of the neck.

* * * * *